United States Patent [19]

Hansen

[11] 4,252,165

[45] Feb. 24, 1981

[54] LOG ACTUATED LOG SPLITTER

[76] Inventor: Andre J. Hansen, 10870 Mason Rd., Fowlerville, Mich. 48836

[21] Appl. No.: 70,009

[22] Filed: Aug. 27, 1979

[51] Int. Cl.[3] ..... B27L 7/00

[52] U.S. Cl. ..... 144/193 A

[58] Field of Search ..... 144/193 R, 193 A, 3 K

[56] References Cited

U.S. PATENT DOCUMENTS

| | | | |
|---|---|---|---|
| 3,077,214 | 2/1963 | Brukner | 144/193 A |
| 3,640,323 | 2/1972 | Helle | 144/193 A |
| 4,076,062 | 2/1978 | Kanik | 144/193 A |
| 4,116,251 | 9/1978 | Graney | 144/193 R |

*Primary Examiner*—W. Donald Bray
*Attorney, Agent, or Firm*—Ian C. McLeod

[57] ABSTRACT

A power operated log splitter adapted for the relative movement of a wedge means (14) and backing plate means (16) between spaced apart first and second positions (A and B) by the linear movement of an operating arm (12) of a hydraulic cylinder (11) mounting the wedge means (14) on the backing plate means (16) from an idle position (A) towards and away from the fixed backing plate means (16) or wedge means (14) to split the logs (100) is described. The log splitter includes a moveable pressure plate (18), preferably mounted on the backing plate (16), and a mechanical linkage means (19) connected to the moveable pressure plate (18) which actuates a valved control means (17) for the hydraulic cylinder (11) when the pressure plate (18) is in contact with a log (100) to initiate movement of the operating arm (12). Upon splitting of the log (100) and removal from the spaced apart positions (A and B) the pressure plate (18) disengages the linkage means (19) from the control valve (17) to return the operating arm (12) to the idle position (A). The wedge means (14) is provided with a projection which interferes with an adjustable block on the linkage means (19) adjacent the idle position (A) to stop the arm (12). The log splitter is particularly adapted for use by a single operator.

12 Claims, 5 Drawing Figures

START SPLIT MODE

HALF SPLIT MODE

MANUAL OR EMERGENCY RETURN MODE

AUTOMATIC RETURN MODE

LOG ACTUATED LOG SPLITTER

BACKGROUND OF THE INVENTION

1. Field of the Invention

Figure 1:
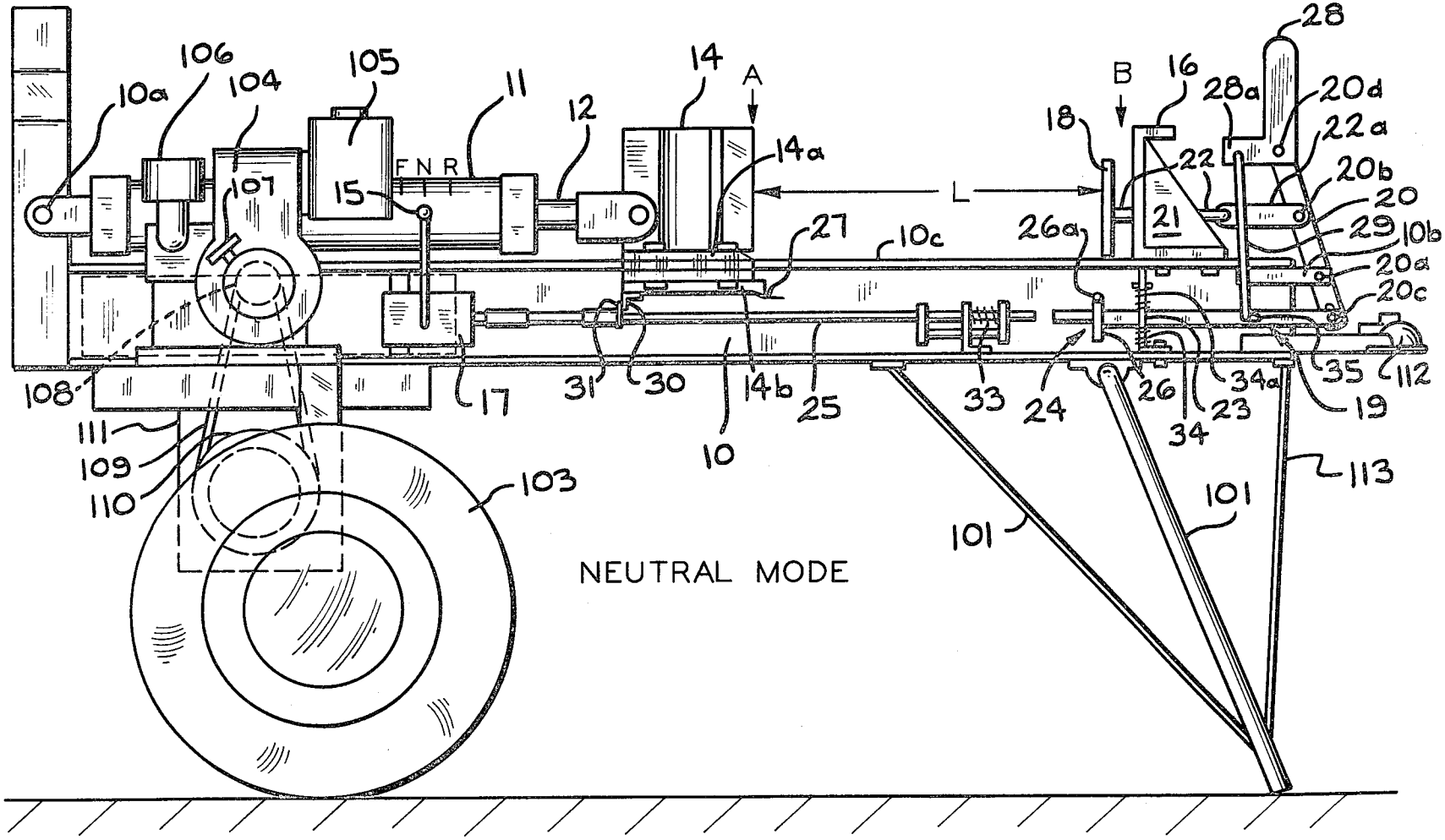

The present invention relates to a log splitter with means for actuating an operating arm of a hydraulic cylinder by a log provided between relatively moveable wedge means and backing plate means in spaced apart first and second positions for splitting and for return when the split log is removed from between the positions. In particular, the present invention relates to a log splitter which is activated by a moveable pressure plate provided on the backing plate means.

2. Prior Art

A general description of log splitters appears in *Popular Science* pages 101 to 104 August 1979. The most pertinent prior art is generally described in U.S. Pat. Nos. 1,666,795; 3,280,864; 3,640,323; 3,760,854; 3,779,295; 3,938,567; 4,061,168; 4,076,062; 4,103,724; 4,116,251; 4,128,117 and 4,141,396. In general these patents describe power operated log splitters including a frame means having two spaced apart first and second positions, a hydraulic cylinder having an operating arm linearly moveable from an idle position in the first position towards the second position and a wedge means and a backing plate means, one of which is fixed and the other of which is mounted on the operating arm and is moveable in a line between the first and second positions for splitting logs positioned on the frame means.

U.S. Pat. No. 3,077,214 to Brukner is the closest known prior art to the present invention and describes a complex linkage means for automatically cycling the operating arm of a hydraulic cylinder. The cycling mechanism is particularly described at column 7, lines 26 to 53; column 10, lines 76 to 40 and column 11, lines 69 to column 12, line 6 of this patent. Basically a mechanical linkage is described, with a block to engage a projection of shoe 103 from the operating arm or ram 100 so as to automatically return the operating arm of the hydraulic cylinder to the idle position. The same linkage has a repeater block 290 on stop link 165 for engagement with the projection on shoe 103 to automatically cycle the arm 100 from the idle position. The Brukner patent describes a complicated mechanism for increasing the pressure for log splitting; however, the operating arm 100 moves a full stroke on each cycle.

Most logs are not cut to the exact same length and no two logs require the exact same splitting force. One log may split after the wedge has penetrated only an inch or so, another may require forcing the wedge half way or the entire length of the log as is the case with dry burley oak. The prior art hydraulic log splitters do not solve this problem and generally the operating arm moves the same stoke on each cycle which is time consuming and expensive. What is needed is a means for actuating the operating arm of the hydraulic cylinder in the presence of the unsplit log and which returns the operating arm to the idle position as soon as the log is split.

OBJECTS

It is therefore an object of the present invention to provide a log splitter which is directly responsive to the splitting of the log such that the operating arm recycles towards the idle position upon splitting of the log. It is further an object of the present invention to provide a log splitter which does not need to return the operating arm to the idle position before initiating a new splitting cycle. It is further an object of the present invention to provide a relatively inexpensive, rugged and reliable improved log splitter. These and other objects will become increasingly apparent by reference to the following description and to the drawings.

IN THE DRAWINGS

FIG. 1 is a front view of the preferred portable log splitter with support means for the frame including wheels and legs and a motor for driving a hydraulic pump for a hydraulic cylinder.

FIGS. 2 to 5 are partial front views of the various operating modes of the preferred powered log splitter of the present invention shown in FIG. 1 without the support means for the frame or the motor for driving the hydraulic pump, particularly illustrating a moveable pressure plate mounted on a backing plate means which when moved towards the backing plate means by an unsplit log activates a mechanical linkage to a valved control means for a hydraulic cylinder to extend an operating arm of the cylinder and when the log is split the moveable pressure plate moves away from the backing plate to cause the linkage to move the valved control means so as to retract the operating arm.

DESCRIPTION OF THE INVENTION

The present invention relates to a power operated log splitter including a frame means having spaced apart first and second positions, a drive means mounted on the frame means including a hydraulic cylinder having a linearly moveable operating arm moveable from an idle position adjacent the first position towards the second position and a power means providing hydraulic power to the cylinder for reciprocating movement of the operating arm between the positions, a wedge means and a backing plate means in spaced relationship in the first and second positions such that the wedge means and backing plate means cooperate through movement of the wedge means or the backing plate means by the operating arm in a line towards the backing plate means or wedge means for splitting logs positioned on the frame means between the positions and a selectively operable valved control means providing for movement of the operating arm and the wedge means or backing plate means from the idle position for log splitting by the wedge means and for return to the idle position the improvement which comprises: a moveable pressure plate mounted between the positions in the line between the wedge means and backing plate means such that the pressure plate is moveable by a log to be split; and mechanical linkage means connected between the moveable pressure plate and the valved control means such that the operating arm is actuated from the idle position by a log to be split moving the moveable pressure plate and such that the operating arm is returned towards the idle position upon removal of the split log from between the spaced apart first and second positions on the frame means.

The present invention also relates to a power operated log splitter including a frame means having spaced apart first and second positions, a drive means mounted on the frame means including a hydraulic cylinder having a linearly moveable operating arm moveable from an idle position adjacent the first position towards the second position and a power means providing hydraulic power to the cylinder for reciprocating movement of the operating arm between the positions, a wedge means and backing plate means in spaced relationship in the first and second positions such that the wedge means and backing plate means cooperate through movement of the wedge means or the backing plate means by the operating arm in a line towards the backing plate means or wedge means for splitting logs positioned on the frame means between the positions and a selectively operable valved control means providing for movement of the operating arm and the wedge means or backing plate means from the idle position for log splitting by the wedge means and for return to the idle position the improvement which comprises: a moveable pressure plate mounted on the backing plate means in the line between the wedge means and backing plate means such that the pressure plate moves towards and away from the backing plate means on the line; and mechanical linkage means connected between the moveable pressure plate and the valved control means such that the operating arm is actuated from the idle position by an end of a log to be split forcing the moveable pressure plate towards the backing plate means and such that the operating arm is returned towards the idle position upon removal of the split log from between the spaced apart first and second positions on the frame means.

SPECIFIC DESCRIPTION

The power operated log splitter includes a frame means 10 having spaced apart first and second positions A and B, a drive means mounted on the frame 10 including a hydraulic cylinder 11 having a linearly moveable operating arm 12 which is moveable from an idle position adjacent the first position A towards the second position B. Power means shown, as a box 13 in FIGS. 2 to 5 and shown in detail in FIG. 1, provides hydraulic power to the cylinder 11 for reciprocating movement of the operating arm 12 between the positions A and B. A wedge 14 is attached to the operating arm 12 and a fixed backing plate 16 is attached to the frame 10 adjacent the second position B in spaced relationship to the first position A and wedge 14. The wedge 14 and backing plate 16 cooperate through movement of the wedge 14 by the operating arm 12 in a line L (FIG. 1) towards the backing plate 16 for splitting logs 100 positioned on the frame 10 between the positions A and B. A selectively operable valved control means 17 with a manual control valve actuator 15 activates the wedge 14 on the operating arm 12 from the idle position at A for log splitting by the wedge 14 as it moves towards position B and for return to the idle position at A.

Figure 2:
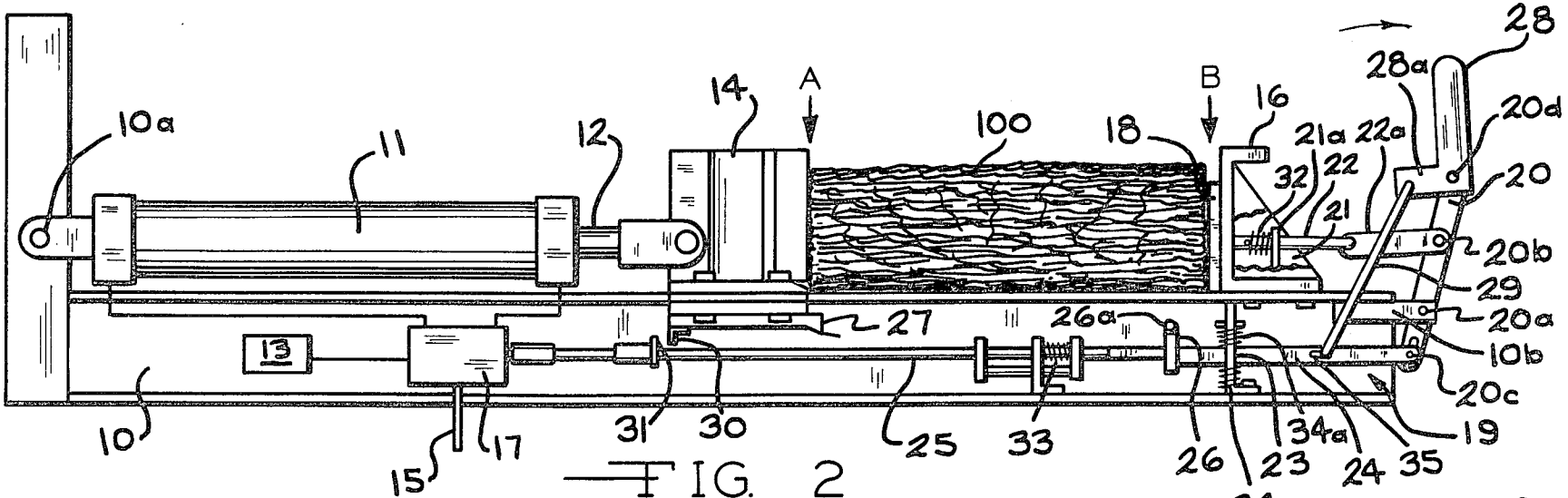
Figure 3:
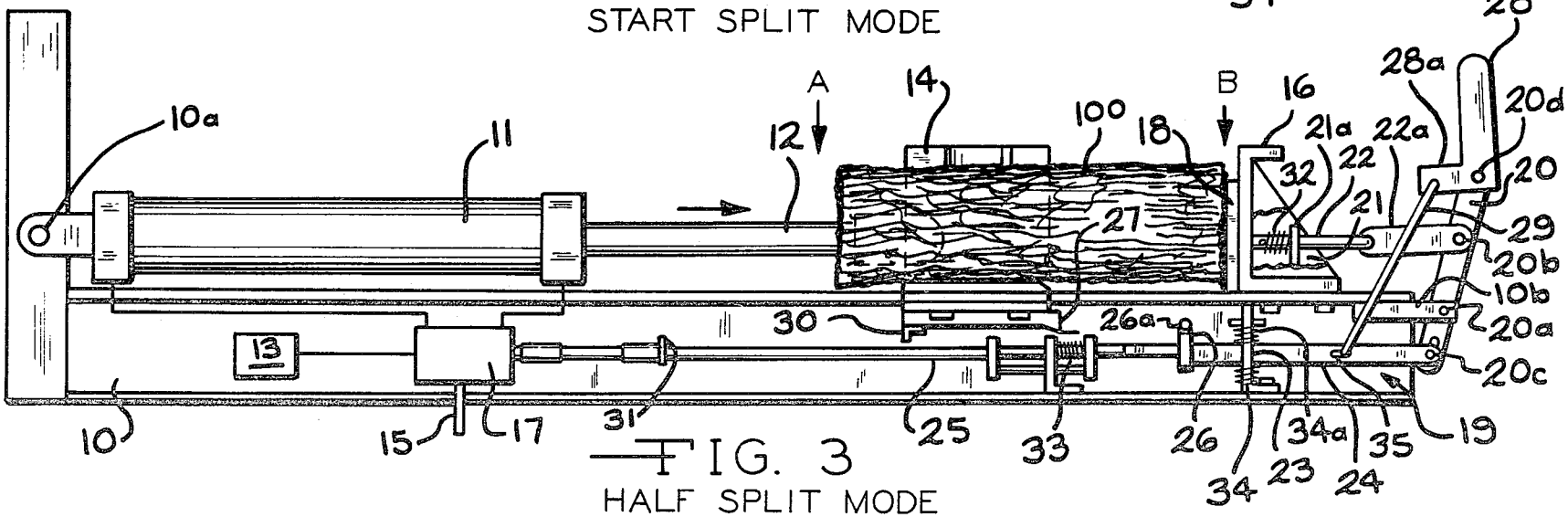

In the improved splitter, a moveable pressure plate 18 is mounted on the backing plate 16 in the line between the wedge 14 and backing plate 16 such that the pressure plate 18 moves towards and away from the backing plate 16 on line L. A mechanical linkage 19 is connected between the moveable pressure plate 18 and the valved control means 17 such that the operating arm 12 and wedge 14 is actuated from the idle position at A by an end of a log 100 to be split forcing the moveable pressure plate 18 towards the backing plate 16 at position B as shown in FIG. 2 and such that the wedge 14 is returned towards the idle position at A upon removal of the split log 100 from line L between the spaced apart first and second positions A and B on the frame 10 as shown in FIG. 1. The mechanical linkage means 19 includes a manually operable lever 20 pivotally mounted at **20*a* on the frame 10 by means of bracket 10*b* attached to the frame 10 opposite the moveable pressure plate 18 and behind the backing plate 16 such that the lever 20 pivots at 20*a* towards and away from the backing plate 16. The backing plate 18 is held in place by support member 21 attached to the frame 10. The moveable pressure plate 18 includes a rod 22 supported by bracket 21*a* which is pivotably connected by link 22*a* at pivot 20*b* to the lever 20 on one side of the pivot 20*a* adjacent a handle 28. On the other side of the pivot 20*a*, a pivot 20*c* is connected to a short actuating rod 24 which is slideably mounted through bracket 23 mounted on the frame 10 such that the short actuating rod 24 and a long actuating rod 25 together activate the valved control means 17 as part of the mechanical linkage 19 due to movement of the pressure plate 18 by a log 100 to be split towards the backing plate 16, to thereby move the wedge 14 away from the idle position at A as shown in FIGS. 2 and 3. The handle 28 on lever 20 can also be used to manually activate the operating arm 12 from the idle position A by movement away from the backing plate 16 as shown in FIG. 2 by the arrow adjacent the handle 28**.

Figure 5:
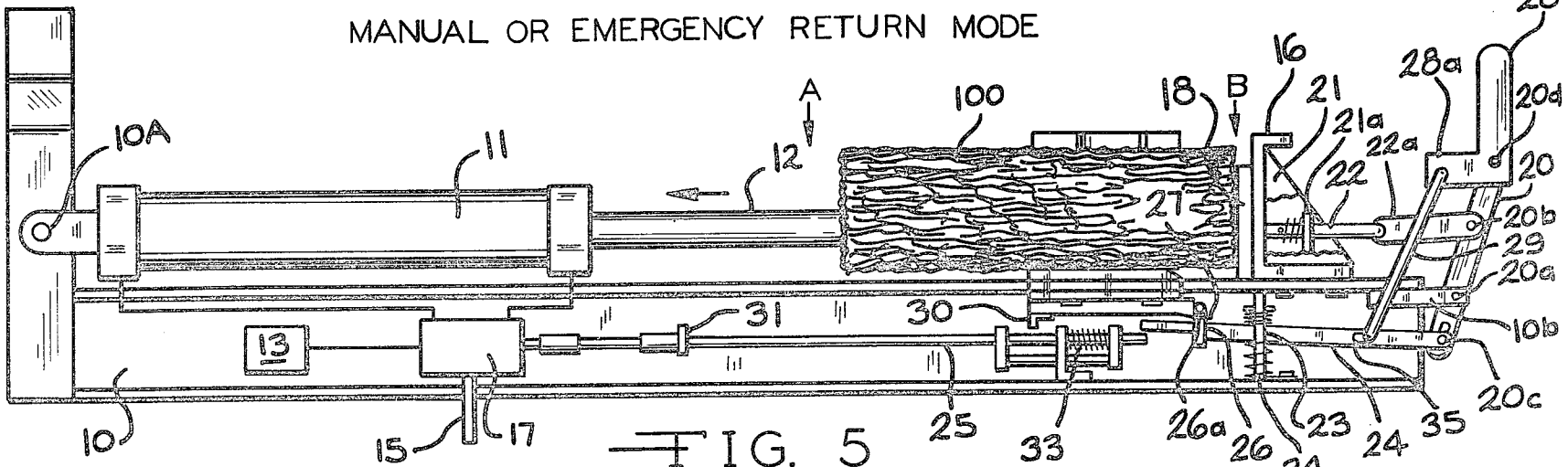

A cam 26 is mounted on an end of the short section 24 of the linkage means 19 away from the pivot **20*c*. A cam lifter 27 is mounted on the wedge 14 so as to lift and disconnect the short actuating rod 24 from the long actuating rod 25 upon full extension of the operating arm 12 and wedge means 14 towards the backing plate 16 to thereby automatically return the actuating arm 12 towards the idle position A as shown in FIG. 5. Thus as shown in FIG. 1 and as discussed hereinafter, the long actuating rod 25 by means of spring 33 moves the valve control means 17 into the retract (R) position because short actuating rod 24 is lifted by lifter 27 on cam 26. The cam 26 includes a knob 26*a* which is picked up by the cam lifter 27 on the wedge 14**.

Figure 4:
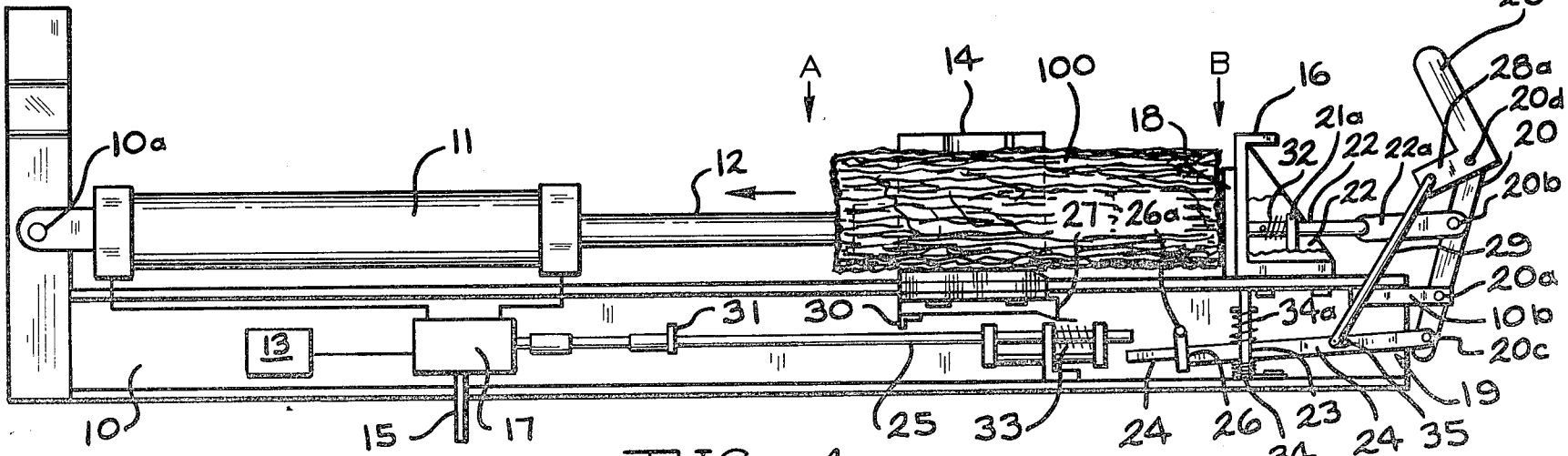

The handle 28 on the lever 20 is rotatable on pivot **20*d* towards the pressure plate 18 as shown in FIG. 4. The handle 28 and the short activating rod section 24 are connected at extension 28*a* by a rod 29 such that the short section 24 can be manually disconnected from the longer actuating rod section 25 by rotating the handle 28 on the lever 20 which moves the short section 24 downward to manually return the wedge 14 towards the idle position at A as shown in FIG. 4. The rod 24 includes a slot 35 which allows movement of the lever 20 around pivot 20*a* sufficiently to allow for pressure plate 18 movement towards the backing plate 16 without lifting the short section 24**.

A projection 30 is provided on the wedge 14 and a slideably adjustable block 31 is mounted on the long actuating rod section 25 such that the block 31 and projection 30 can be provided in an interference position with each other near the idle position at A to actuate the valved control means 17 and stop the wedge 14 at the idle position at A. The block 31 is adjustable by being moveable along the long section 25 and fixed in position with a set screw (not shown). The valved control means 17 is preferably mounted on the frame 10 such that the actuating rod 25 directly actuates the valved control means 17 as shown in FIGS. 1 to 5. The valved control means 17 has three positions: neutral (N) in the center, forward (F) on the left of neutral and wedge 14 retract (R) on the right as shown in FIG. 1. The valve control means 17 is normally in the retract (R) position when the pressure is not applied by rod 25 except when block 31 and stop 30 are together. Other linkages functionally the same as linkage 19 can be used (not shown).

A spring 32 is provided which urges the moveable pressure plate 18 away from the backing plate 16 in absence of pressure from a log 100 being split. Spring 33 urges the rod section 25 towards the rod section 24. Springs 34 and 34*a* mounted around bracket 23 urges the short rod section 24 upwards in line with the long actuating rod 25.

The wedge 14 is preferably slideably connected to the frame 10 means for movement between the spaced apart first and second positions A and B as shown in FIGS. 1 to 5 by means of spaced apart plates 14*a* and 14*b* on frame I member 10*c*. The hydraulic cylinder 11 is preferably pivotably mounted on the frame 10 at pivot 10*a*. Other known means for rigidly mounting the cylinder 11 on the frame 10 can be used.

Preferably the frame 10 is mounted on a leg 101 supported by braces 101 and 113 and on wheels 103 for ease of transport. Power is provided by motor 104 mounted on the frame 10 adjacent the cylinder 11. A gasoline tank 105 and filtered air inlet 106 are mounted on the engine 105. A pull cord 107 is used for starting the engine 105. A belt 109 is mounted on a pulley 108 (shown in broken lines) on the motor 105 and a second pulley 110 for driving a hydraulic pump 111. A hitch 112 is attached to the frame 10. All of these features are known to the prior art.

DESCRIPTION OF SPLITTING CYCLE

The log 100 to be split is placed on the splitting frame 10 and is forced against the spring 32 loaded pressure plate 18. The pressure plate 18, through the linkage means 19, actuates the control valve 17, and allows hydraulic fluid to flow and the wedge 14 starts to split the log 100. When the log 100 has been split and fallen aside off the frame 10, there is no pressure on the pressure plate 18. The pressure plate 18 moves away from the backing plate 16 and then the control valve 17 is allowed to move to the return cycle mode. When the arm 12 returns, this member by means of long actuating rod 25 deactivates the hydraulic control valve 17 to neutral (N) as shown in FIG. 1 by means of projection 30 and block 31 or it could be automatically recycled by moving the control means 17 to forward (F) as also shown in FIG. 1. If the wedge 14 moves its total length without the log 100 releasing from the bed, the pressure plate 18 is deactivated by the cam 26 and lifter 27 lifting short section 24 which releases the linkage to the hydraulic control valve 17, allowing the operating arm 12 to return to the idle mode A as shown in FIG. 5. In case of an emergency or other problem, the wedge 14 can manually be returned to the idle position at A by pivoting the handle 28 towards the backing plate 16 as shown in FIG. 4.

I claim:

1. In a power operated log splitter including a frame means having spaced apart first and second positions, a drive means mounted on the frame means including a hydraulic cylinder having a linearly moveable operating arm moveable from an idle position adjacent the first position towards the second position and a power means providing hydraulic power to the cylinder for reciprocating movement of the operating arm between the positions, a wedge means and a backing plate means in spaced relationship in the first and second positions such that the wedge means and backing plate means cooperate through movement of the wedge means or the backing plate means by the operating arm in a line towards the backing plate means or wedge means for splitting logs positioned on the frame means between the positions and a selectively operable valved control means providing for movement of the operating arm and the wedge means or backing plate means from the idle position for log splitting by the wedge means and for return to the idle position the improvement which comprises:

(a) a moveable pressure plate mounted between the positions in the line between the wedge means and backing plate means wherein the pressure plate is moveable in a first direction by a log to be split and is provided with means for moving the moveable pressure plate in the opposite direction in absence of a log to be split; and (b) mechanical linkage means connected between the moveable pressure plate and the valved control means to actuate the control means which starts the operating arm for log splitting when the moveable pressure plate is moved in the first direction and to actuate the control means to return the operating arm when the moveable plate is moved in the opposite direction wherein the operating arm is actuated from the idle position by a log to be split moving the moveable pressure plate and linkage to the control means and wherein the operating arm is returned towards the idle position upon removal of the split log from between the spaced apart first and second positions on the frame means thereby moving the moveable plate away from the backing plate.

2. In a power operated log splitter including a frame means having two spaced apart first and second positions, a drive means mounted on the frame means including a hydraulic cylinder having a linearly moveable operating arm moveable from an idle position adjacent the first position towards the second position and a power means providing hydraulic power to the cylinder for reciprocating movement of the operating arm between the positions, a wedge means and a backing plate means in spaced relationship in the first and second positions such that the wedge means and backing plate means cooperate through movement of the wedge means or the backing plate means by the operating arm in a line towards the backing plate means or wedge means for splitting logs positioned on the frame means between the positions and a selectively operable valved control means providing for movement of the operating arm and the wedge means or backing plate means on the operating arm from the idle position for log splitting by the wedge means and for return to the idle position the improvement which comprises:

(a) a moveable pressure plate mounted on the backing plate means in the line between the wedge means and backing plate means wherein the pressure plate moves towards and away from the backing plate means on the line and is provided with spring means for moving the moveable plate away from the backing plate in absence of a log to be split; and (b) mechanical linkage means connected between the moveable pressure plate and the valved control means to actuate the control means for log splitting when the moveable pressure plate is moved towards the backing plate and to activate the control means to return the operating arm when the moveable plate is moved away from the backing plate wherein the operating arm is actuated from the idle position by an end of a log to be split forcing the moveable pressure plate towards the backing plate means and wherein the operating arm is returned towards the idle position upon removal of the split log from between the spaced apart first and second positions on the frame means.

3. In a power operated log splitter including a frame means having spaced apart first and second positions, a drive means mounted on the frame means including a hydraulic cylinder having a linearly moveable operating arm moveable from an idle position adjacent the first position towards the second position and power means providing hydraulic power to the cylinder for reciprocating movement of the operating rod between the positions, a wedge means attached to the operating arm, a fixed backing plate means attached to the frame means at the second position in spaced relationship to the wedge means such that the wedge means and backing plate means cooperate through movement of the wedge means by the operating arm in a line towards the backing plate means for splitting logs positioned on the frame means between the positions and a selectively operable valved control means providing for movement of the wedge means on the operating arm from the idle position for log splitting by the wedge means and for return to the idle position, the improvement which comprises:

(a) a moveable pressure plate mounted on the backing plate means in the line between the wedge means and backing plate means wherein the pressure plate moves towards and away from the backing plate means on the line and is provided with spring means for moving the moveable plate away from the backing plate in absence of a log to be split; and (b) mechanical linkage means connected between the moveable pressure plate and the valved control means to actuate the control means for log splitting when the moveable pressure plate is moved towards the backing plate and to activate the control means to return the operating arm when the moveable plate is moved away from the backing plate wherein the operating arm and wedge means is actuated from the idle position by an end of a log to be split forcing the moveable pressure plate towards the backing plate means and wherein the wedge means is returned towards the idle position upon removal of the split log from between the spaced apart first and second positions on the frame means.

4. The log splitter of claim 3 wherein the wedge means is slideably connected on the frame means for movement between the spaced apart first and second positions.

5. The log splitter of claim 3 wherein the mechanical linkage means includes a manually operable lever pivotally mounted on the frame means opposite the moveable pressure plate and behind the backing plate such that the lever pivots towards and away from the backing plate by means of a handle on the lever, wherein the moveable pressure plate includes a rod pivotably connected to the lever on one side of the pivot for the lever adjacent the handle and on the other side of the pivot for the lever is pivotably connected to an actuating rod slideably mounted on the frame means wherein the actuating rod activates the valved control means due to movement of the pressure plate by a log to be split towards the backing plate means so as to move the wedge means away from the idle position and wherein the handle can be used to activate the operating arm from the idle position manually by movement away from the backing plate means.

6. The log splitter of claim 4 wherein the actuating rod means is divided into two closely spaced apart sections such that there is a short section adjacent to the moveable pressure plate and pivotably attached to the lever and a longer section which together activate the valved control means, wherein a cam means is mounted on an end of the short section of the actuating rod away from the lever and adjacent the longer section, wherein a cam lifter is mounted on the wedge means so as to lift and thereby disconnect the short section from the longer section upon full extension of the operating arm and wedge means towards the backing plate means wherein the longer section of the rod includes a second spring means which moves the longer section towards the short section to thereby automatically return the actuating arm towards the idle position by moving the valved control means to a retract position.

7. The log splitter of claim 6 wherein the cam means includes a knob which is picked up by the cam lifter means on the wedge means.

8. The log splitter of claim 6 wherein the handle on the lever is rotatable on the lever towards the backing plate, wherein the handle and the short section of the actuating rod are connected such that the short section can be manually disconnected from the longer section by rotating the handle on the lever to disconnect the short section from the longer section to thereby return the wedge and operating arm towards the idle position.

9. The log splitter of claim 8 wherein the handle and the short section are connected by a second rod and wherein the short section has a slot for attaching of the rod which allows the lever to pivot to move the pressure plate without disconnecting the short section.

10. The log splitter of claim 5 wherein a projection is provided on the wedge means and an adjustable block is mounted on the actuating rod so that the block and projection can be provided in an interference position with each other in the idle position so as to move the valved control means into the idle position.

11. The log splitter of claim 10 wherein the block is adjustable by being moveable along the actuating rod to fixed positions.

12. The log splitter of claim 5 wherein the valved control means is mounted on the frame means in line with the actuating rod such that the actuating rod directly actuates the valved control means.

* * * * *